US006450242B1

(12) United States Patent
Kroos et al.

(10) Patent No.: US 6,450,242 B1
(45) Date of Patent: Sep. 17, 2002

(54) METHOD AND DEVICE FOR CASTING THIN BILLETS

(75) Inventors: Joachim Kroos, Meine; Hans-Jürgen Schemeit, Langenfeld; Karl-Heinz Spitzer, Clausthal-Zellerfeld; Ulrich Urlau, Moers, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/380,334

(22) PCT Filed: Feb. 24, 1998

(86) PCT No.: PCT/DE98/00579

§ 371 (c)(1),
(2), (4) Date: Sep. 7, 1999

(87) PCT Pub. No.: WO98/39121

PCT Pub. Date: Sep. 11, 1998

(30) Foreign Application Priority Data

Mar. 5, 1997 (DE) ..... 197 11 116

(51) Int. Cl.[7] ..... B22D 11/06; B22D 11/10; B22D 11/18

(52) U.S. Cl. ..... 164/479; 164/453; 164/429; 164/437; 164/471; 164/488; 164/489; 164/449.1; 164/450.1

(58) Field of Search ..... 164/479, 453, 164/429, 471, 488, 489, 490, 437, 438, 439, 440, 449.1, 450.1, 450.3, 450.5; 222/590, 591, 592, 593, 594

(56) References Cited

U.S. PATENT DOCUMENTS 4,651,803 A * 3/1987 Tsuru et al. ..... 164/454
4,928,748 A * 5/1990 Guthrie et al. ..... 164/479
5,074,354 A * 12/1991 Tosini et al. ..... 164/453
5,148,885 A * 9/1992 Ashok ..... 164/479
5,238,049 A * 8/1993 Martin ..... 164/479
5,355,937 A * 10/1994 Mueller et al. ..... 164/479
5,381,854 A * 1/1995 Thompson et al. ..... 164/453
5,439,047 A * 8/1995 Eckert ..... 164/471
5,538,071 A * 7/1996 Johansson et al. ..... 164/479
5,709,260 A * 1/1998 Wagstaff et al. ..... 164/453
5,913,357 A * 6/1999 Hanazaki et al. ..... 164/453
5,915,459 A * 6/1999 Urlau et al. ..... 164/479
5,934,358 A * 8/1999 Ellis et al. ..... 164/466

FOREIGN PATENT DOCUMENTS

DE EP 0 439 034 A1 * 6/1992 ..... B22D/11/06

* cited by examiner

*Primary Examiner*—M. Alexandra Elve
*Assistant Examiner*—Kevin P. Kerns
(74) *Attorney, Agent, or Firm*—Cohen, Pontani, Lieberman & Pavane

(57) ABSTRACT

A method and a belt casting device for producing thin billets, in particular composed of steel, has an endless belt to which liquid metal is supplied via a feed device which has a casting channel and is connected to a metallurgical vessel. In this case, the feed device is in the form of a casting channel which has a first casting channel part in the form of a restriction channel part, and which has a second casting channel part whose opening faces the endless belt and whose size corresponds to the cross-sectional area of the finished product. The feed device is connected to a container to which liquid melt can be fed from a metallurgical vessel. Measurement elements are provided, which can be used to detect the level of the liquid melt in the container and/or the thickness of the billet located on the endless belt. Furthermore, the measured values are connected via a measurement and control element to an actuator which is connected to an element for adjusting the outlet rate from the metallurgical vessel.

12 Claims, 3 Drawing Sheets

METHOD AND DEVICE FOR CASTING THIN BILLETS

BACKGROUND OF THE INVENTION

1. Field of the Invention

Figure 1:
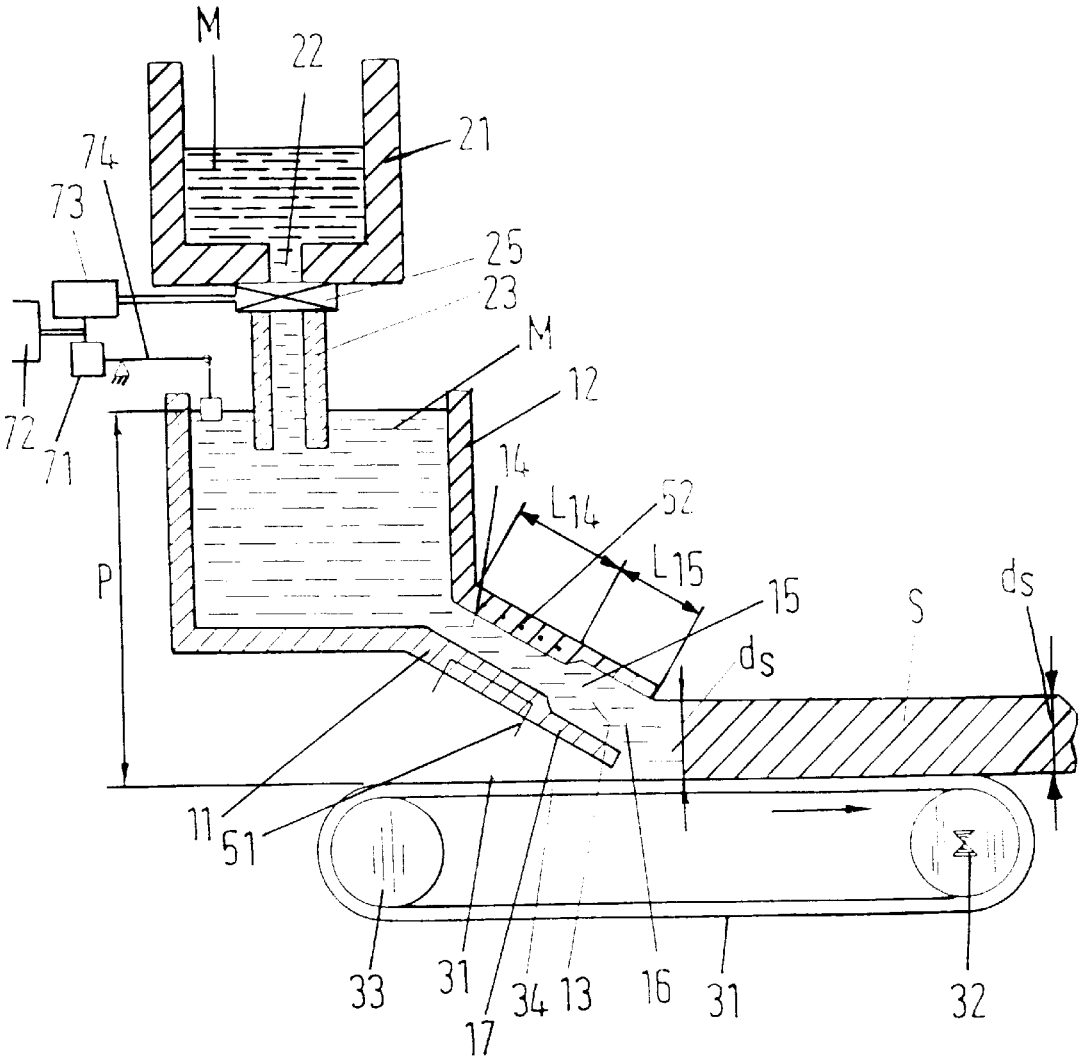

The invention relates to a method for casting thin billets, in particular composed of steel, having a belt casting device, in the case of which liquid metal from a metallurgical vessel is fed via a feed device to an endless belt, and to a corresponding belt casting device.

2. Discussion of the Prior Art

When producing strips using the belt casting method with the belt surface being cooled on one side, difficulties occur in producing these strips with tight thickness tolerances.

According to German Reference DE 35 21 778 C2, it is known for metal billets to be produced in the form of strips, in which case liquid metal is applied from a nozzle onto the cooling surface with a heat sink which moves past the nozzle with a narrow gap. The nozzle is in the form of a slotted nozzle in order to produce strips. In this case, the distance between the nozzle lip on the outlet side and the cooling surface of the heat sink is adjustable. The width of the nozzle (unobstructed distance) of the nozzle lip on the billet start and billet outlet side is arranged at a distance which corresponds to the length of the cold solidification front of the strip to be cast.

Strips produced using this method and apparatus have not provided satisfactory results.

SUMMARY OF THE INVENTION

The invention is based on the aim of providing a method with a corresponding apparatus for casting thin billets, in the case of which an endless strip can be produced with tight tolerances and with the desired strip thickness using simple physical means and with reliable process control.

According to the invention, the feed rate of the liquid metal is kept constant with respect to the outlet rate of the finished product, that is to say of the cast strip which is drawn off the endless belt system. Before the liquid metal strikes the endless belt, the flow rate of the liquid metal stream is reduced to such an extent that it strikes the endless belt at a speed corresponding to the belt output speed, and the liquid metal stream has a thickness which is matched to the desired billet thickness in the impact area.

The level of the liquid metal in the metallurgical vessel upstream of the feed device is in this case set in such a manner that the geodetic height is given by $P<10\times d_s$, where P=level and $d_s$=billet thickness. Both the level P and the billet thickness $d_s$ may be used as a control variable in this case.

In order to maintain the level height exactly, measurement elements are provided for detecting the level, for example a float or a bubble device, and for maintaining the strip thickness, for example a distance sensor which acts via a measurement and control device on an actuator which controls shut-off elements to regulate the flow rate. These shut-off elements may be either slides or a plug.

In order to adjust the speed of the liquid metal stream reliably, the casting channel is designed so that the first casting channel part forms a restriction channel part. The opening of the second casting channel part is designed so that it has the same cross-sectional area as the subsequent finished product.

In an advantageous refinement, the restriction channel part is in the form of a constriction element and in this case has a thickness which is less than the subsequent billet thickness, corresponding to $d_w=0.5\times d_s$ to $0.8\times d_s$, where $d_w$=thickness of the restriction channel part and $d_s$=billet thickness.

Furthermore, the casting channel has a shape such that the first channel part, which is in the form of a restriction channel, is longer than the second channel part.

In a further advantageous embodiment, a restriction element is provided in the restriction channel, is in the form of a filter and in this case has a free area of 0.6 to 0.8×the cross-sectional area of the casting channel. The free area of this filter may in this case comprise a hole incorporated in a refractory plate.

In one embodiment, the liquid metal stream is heated in the region of the feed device. For this purpose, it is proposed that the wall of the casting channel be formed from electrically conductive refractory material, and that an induction coil be used as the heating device.

One advantageous embodiment of the invention comprises braking of the liquid metal stream. To this end, an eddy-current brake is provided on its own or in addition to the constriction described above, and its static magnetic field reduces the speed of the liquid metal stream. In a further embodiment, a linear motor is provided, which reduces the speed of the liquid metal stream by producing a moving field in the opposite direction to the flow direction of the melt.

In one particular embodiment, the first casting channel part is in the form of a tube. This tube may be arranged in the bottom of the container, pointing in the vertical direction. The mouth of this outlet tube is in this embodiment connected to a second casting channel part, which is in the form of an opening funnel whose mouth has dimensions which correspond to the finished product. In this case, the second channel part may have cross-sectional areas which become smaller in the flow direction of the melt in the casting channel part, in order to achieve a uniform outlet rate over the billet width.

BRIEF DESCRIPTION IF THE DRAWINGS

Figure 2A:
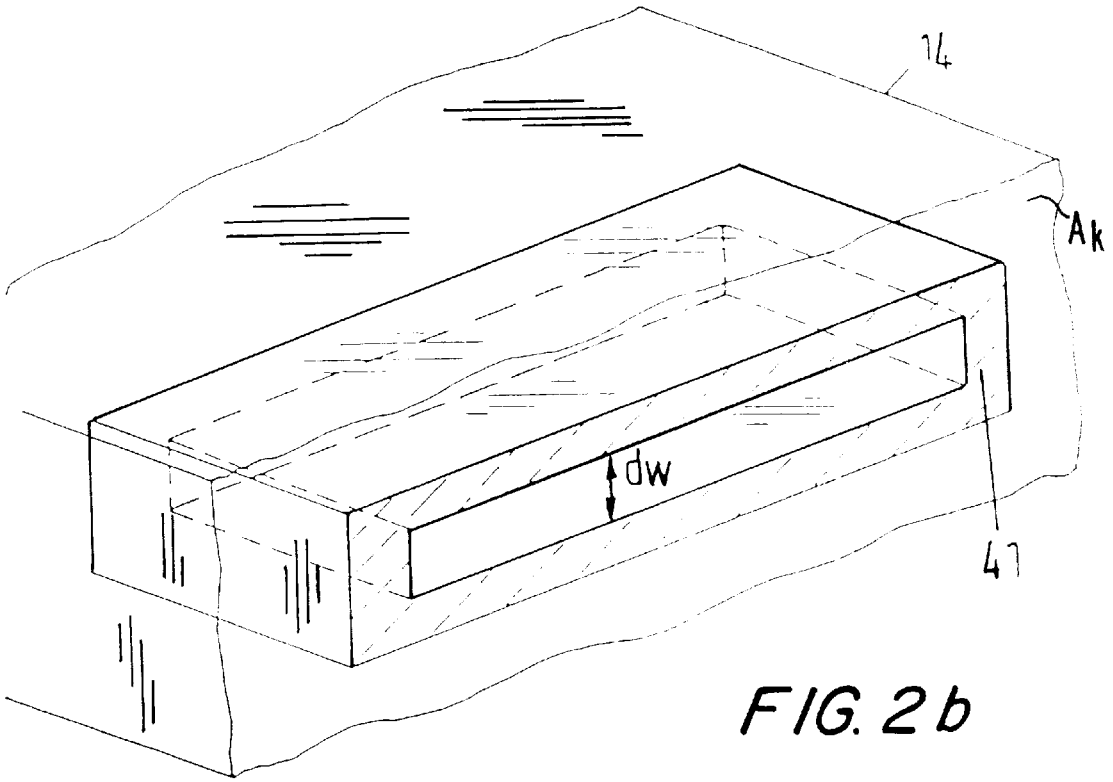
Figure 2B:
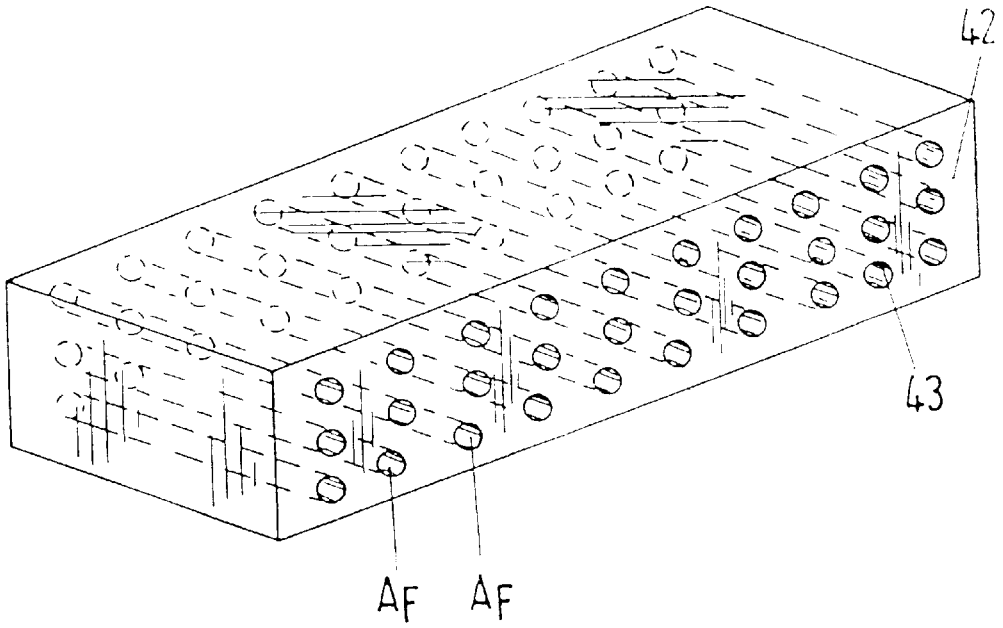
Figure 3:
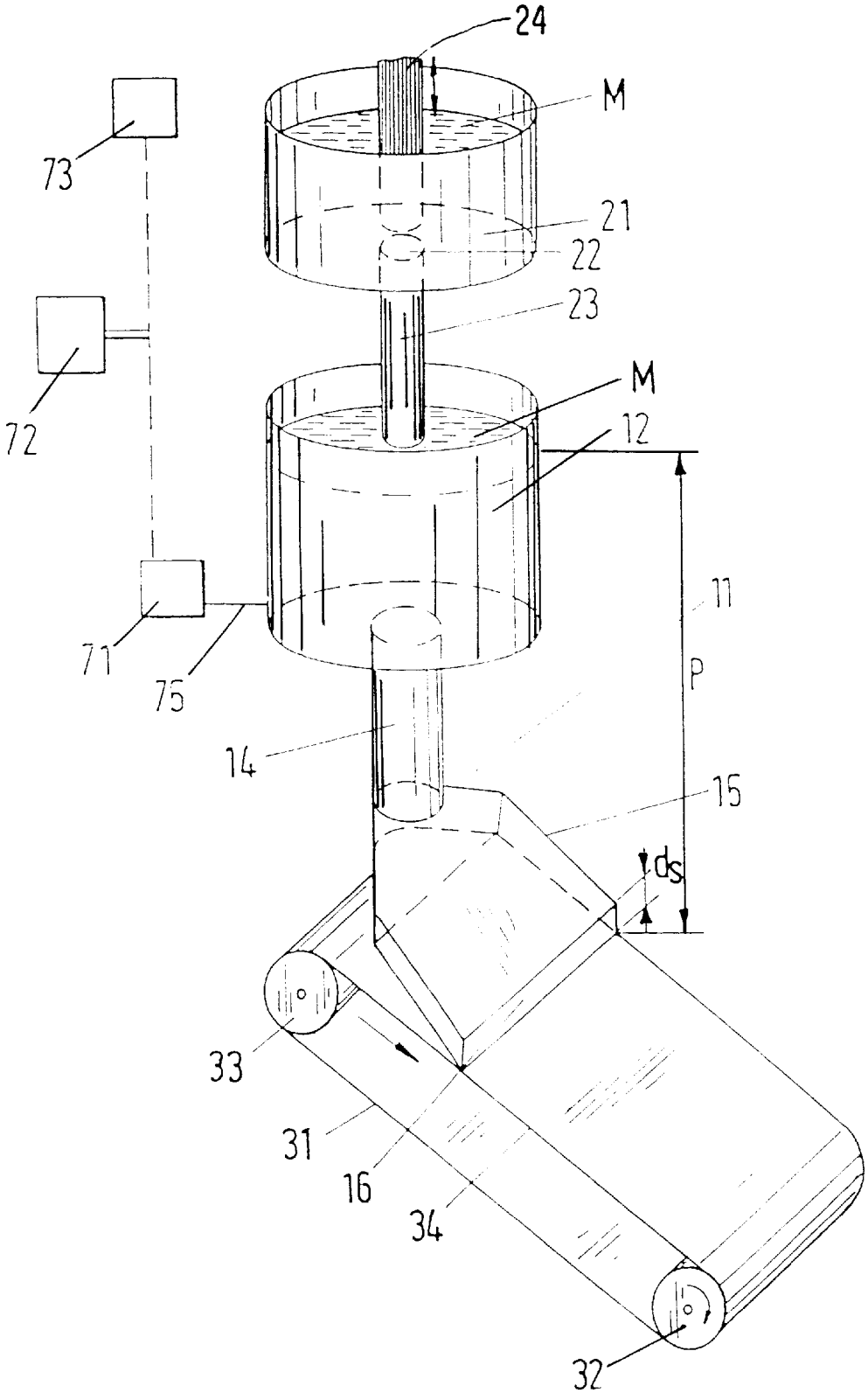

One example of the invention is illustrated in the attached drawing, in which:

FIGS. 1 and 3 show, schematically, the entire belt casting device for producing thin billets, and FIG. 2 shows restriction elements in the casting channel.

DETAILED DESCRIPTION OF PREFERRED EMBODIMENTS

FIGS. 1 and 3 show a metallurgical vessel 21 which is filled with liquid metal M and has a bottom opening 22. A submerged nozzle 23 is arranged on the bottom opening 22 and is immersed in a melt M which is located in a container 12.

The bottom opening 22 of the metallurgical vessel 21 can be closed by a slide 25 in FIG. 1, and by a plug 24 in FIG. 3. The rate at which the metal M flows out of the metallurgical vessel 21 can be controlled infinitely variably via an actuator 73.

The level of the liquid metal M located in the container 12 is detected via a level measurement element 71, to be precise by a float 74 in FIG. 1 and by a bubble device 75 in FIG. 3. The actuator 73 and the level measurement device 71 are connected to a measurement and control element 72.

An endless belt 31 is provided underneath the container 12, and has a driven guide 32 and a free running guide 33.

The liquid metal is deposited on the upper run 34 of the endless belt 31, where it solidifies and is transported away as the finished product S.

In FIG. 1, the feed device 11 is in the form of a casting channel 13, which has a first casting channel part 14 which is in the form of a restriction channel part. This first casting channel part 14 is followed by a second casting channel part 15, which has an outlet opening 16.

The thickness $d_w$ of the restriction channel part is less than the billet thickness $d_s$ preferably 0.5 to $0.8 \times d_s$. The restriction channel part 14 in this case has a length $L_{14}$ which is greater than the length 15 of the second channel part 15.

Instead of the small thickness $d_w$, a restriction element as is illustrated in FIG. 2 can be provided in the first casting channel part 14. This may be in the form of a specific restriction element 41 with a rectangular opening (FIG. 2*a*) or else may comprise a filter 42 which has holes 43 (FIG. 2*b*). The free area $A_F$ is in this case composed of the sum of the holes 43 and, in this case, has a size of 0.6 to $0.8 \times A_K$ (cross-sectional area of the casting channel).

A sketch of a heating device 51 is shown in the wall 17 in the lower part of the feed device 11, and an induction coil 52 is shown in the upper part.

In FIG. 3, the first casting channel part 14 has a tubular shape, which is followed by the second casting channel part 15 of the feed device 11. The second casting channel part is in this case in the form of an opening funnel, which is inclined with respect to the upper run 34 of the endless belt 31.

What is claimed is:

1. A method for casting thin billets with a belt casting device in which liquid metal from a metallurgical vessel is fed via a feed device to an endless belt, the method comprising the steps of:

a) passing liquid metal from the metallurgical vessel into a container to which the feed device is connected;

b) providing a flow restriction channel part as a first casting channel part in the feed device to oppose a liquid metal stream before the liquid metal arrives at the endless belt through a second casting channel part having a larger cross-sectional area, with the first casting channel part thereby reducing the flow rate of the liquid metal stream to such an extent that the liquid metal arrives at the endless belt from an opening of a second casting channel part sized to correspond to a cross-sectional area of a finished billet at a speed which corresponds to a belt output speed and, in an impact area, has a thickness which is matched to a billet thickness;

c) heating the liquid metal stream in a region of the feed device with an induction coil;

d) measuring and stabilizing at a constant value at least one of a level of the liquid metal located in the container and the thickness of the billet located on the endless belt; and e) feeding presently measured values of at least one of the level and the thickness to an actuator which controls an outlet rate of the liquid metal from the metallurgical vessel.

2. The method as defined in claim 1, including setting a feed rate of the liquid metal in the metallurgical vessel so that a geodetic height of a liquid level (P) in the container with respect to a thickness ($d_s$) of a billet is given by $P<10 \times d_s$.

3. The method as defined in claim 1, wherein the heating step includes keeping the liquid metal at a temperature close to its melting point.

4. The method as defined in claim 1, wherein the step of providing a flow restriction part includes providing constriction elements for reducing the speed of the liquid metal stream.

5. A belt casting device for producing thin billets, comprising:

an endless belt;

a metallurgical vessel;

a feed device connected to the metallurgical vessel and having a casting channel arranged so as to feed a liquid metal stream in a flow direction from the vessel to the belt, the casting channel comprising a first casting channel part formed as a flow restriction channel part, and a second casting channel part arranged downstream from and having a larger cross-sectional area than the first casting channel part, and further comprising an opening that faces the endless belt, the opening being sized to correspond to a cross-sectional area of a finished billet;

a container connected to the feed device so that liquid melt can be fed from the metallurgical vessel to the container;

a heating device in a wall of the casting channel, the heating device including an induction coil;

means for measuring at least one of a level of the liquid melt in the container and a thickness of the billet located on the endless belt;

means for adjusting an outlet rate of melt from the metallurgical vessel;

an actuator operatively connected to the adjusting means; and a measurement and control element operative to connect the measuring means to the actuator for actuating the adjusting means in response to measured values from the measuring means.

6. The belt casting device as defined in claim 5, wherein the restriction channel part has a thickness ($d_w$) corresponding to $d_w=0.5$ to $0.8 \times d_s$, where $d_s$=billet thickness.

7. The belt casting device as defined in claim 5, wherein the restriction channel part has a length such that $L_{14}>L_{15}$, where $L_{15}$=length of the second channel part.

8. The belt casting device as defined in claim 5, and further comprising a restriction element provided within the restriction channel part and designed as a filter having a free area ($A_F$)

where $A_F=0.6$ to $0.8 \times A_K$, where $A_K$=cross-sectional area of the casting channel.

9. The belt casting device as defined in claim 8, wherein the free area ($A_F$) of the filter comprises holes which are incorporated in a refractory plate.

10. The belt casting device as defined in claim 5, wherein the casting channel has a wall formed from electrically conductive refractory material.

11. The belt casting device as defined in claim 5, wherein the first casting channel part is formed as a tube having a mouth region with a cross-sectional area formed as an opening funnel, and the second channel part has essentially a common cross-sectional area with the billet.

12. The belt casting device as defined in claim 11, wherein the cross-sectional areas of the casting channel become smaller in the flow direction of the liquid metal stream so as to ensure that the liquid metal has a uniform outlet speed over a width of the metal stream.

* * * * *